US008861987B2

(12) United States Patent
Kashiwagi

(10) Patent No.: US 8,861,987 B2
(45) Date of Patent: Oct. 14, 2014

(54) IMAGE FORMING APPARATUS AND IMAGE FORMING METHOD USING A DECOLORABLE COLOR MATERIAL

(71) Applicants: Kabushiki Kaisha Toshiba, Tokyo (JP); Toshiba Tec Kabushiki Kaisha, Tokyo (JP)

(72) Inventor: Ryota Kashiwagi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 198 days.

(21) Appl. No.: 13/627,817

(22) Filed: Sep. 26, 2012

(65) Prior Publication Data

US 2013/0077983 A1 Mar. 28, 2013

Related U.S. Application Data

(60) Provisional application No. 61/540,482, filed on Sep. 28, 2011.

(51) Int. Cl.

| | |
|---|---|
| ***G03G 15/00*** | (2006.01) |
| ***G03G 15/20*** | (2006.01) |
| ***G03G 21/00*** | (2006.01) |
| *G03G 15/23* | (2006.01) |

(52) U.S. Cl.
CPC ..... *G03G 21/00* (2013.01); *G03G 15/5062* (2013.01); *G03G 15/234* (2013.01)
USPC ..... 399/15; 399/341

(58) Field of Classification Search
CPC ..... G03G 15/5062
USPC ..... 399/15, 82, 341
See application file for complete search history.

(56) References Cited

U.S. PATENT DOCUMENTS

| | | | | |
|---|---|---|---|---|
| 5,394,231 | A * | 2/1995 | Sudo et al. | 399/228 |
| 7,567,767 | B2 * | 7/2009 | Kikuchi | 399/82 |
| 2010/0118361 | A1 | 5/2010 | Iguchi | |

* cited by examiner

*Primary Examiner* — William J Royer
(74) *Attorney, Agent, or Firm* — Patterson & Sheridan LLP

(57) ABSTRACT

An image forming apparatus of an embodiment includes a sensor, a reversing section, an image forming section, and a controller. The sensor reads a sheet side on which an image is to be formed before formation of the image. The reversing section reverses sides of the sheet being conveyed. The image forming section forms the image and a predetermined mark on the same side of the sheet. The controller acquires image data read by the sensor. If the image data contains the mark, the controller causes the reversing section to reverse the sides of the sheet and also causes the image forming section to form the image on a side that becomes a side targeted for printing after the reversion.

20 Claims, 3 Drawing Sheets

IMAGE FORMING APPARATUS AND IMAGE FORMING METHOD USING A DECOLORABLE COLOR MATERIAL

CROSS-REFERENCE TO RELATED APPLICATIONS

This application is based upon and claims the benefit of priority from: U.S. provisional application 61/540482, filed on Sep. 28, 2011; the entire contents all of which are incorporated herein by reference.

FIELD

Embodiments described herein relate generally to the art of an image forming apparatus and an image forming method that form an image on a sheet by using a decolorable color material.

BACKGROUND

There have been image forming apparatuses that form an image with a color material as a toner decolorized by being heated to a certain temperature or higher temperature.

When a sheet holding a toner image formed from such a decolorable color material becomes a used sheet, the toner image is erased (decolorized) by being heated by means of a decolorizing device to the above-described certain temperature or higher temperature. Efforts are being made nowadays to reduce an environmental load by achieving reuse of sheets with these apparatuses.

A sheet holding an image formed from a decolorable color material is subjected to decolorizing treatment for reuse of the sheet. However, in some cases, an image not having been erased completely may still remain on a sheet after the sheet was subjected to decolorizing treatment. The image before being subjected to the erasure is recognized faintly on a base material. Therefore, if an image is formed again on a side on which this ghost image remains, the visibility of the image printed for the second time and subsequent times is degraded.

DETAILED DESCRIPTION

Figure 1:
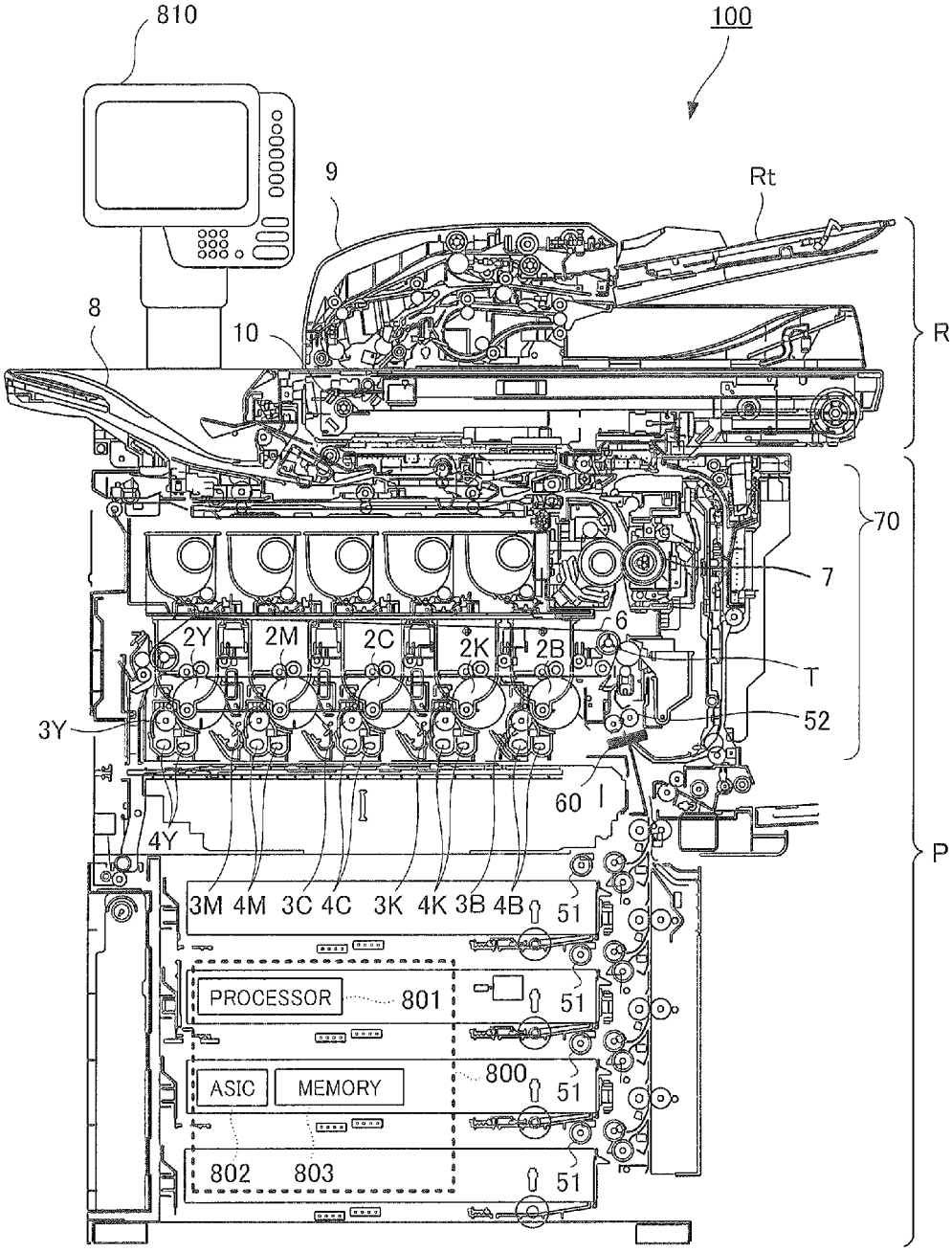
FIG. 1 shows an exemplary structure of an image forming apparatus of an embodiment.

An image forming apparatus of an embodiment includes a sensor, a reversing section, an image forming section, and a controller. The sensor reads a side of a sheet on which an image is to be formed before formation of the image. The reversing section reverses sides of the sheet being conveyed. The image forming section forms an image and a predetermined mark on the same side of the sheet. The controller acquires image data read by the sensor. If the image data contains the mark, the controller causes the reversing section to reverse the sides of the sheet and then causes the image forming section to form the image on the side that becomes a side targeted for printing after the reversion.

An image forming apparatus of an embodiment includes a sensor, a reversing section, an image forming section, and a controller. The sensor reads both sides of a sheet before formation of an image. The reversing section reverses sides of the sheet being conveyed. The image forming section forms an image on the sheet. The controller acquires image data about both the sides read by the sensor. The controller selects a side in a favorable condition on the basis of the acquired image data, and controls the reversing section such that the image is formed on the selected side in a favorable condition by the image forming section.

The image forming apparatus of the present embodiment is an apparatus capable of forming an image with a toner (hereinafter called a decolorable toner) decolorized by being placed at a certain temperature or higher temperature. Further, the image forming apparatus of the present embodiment forms an image (called a contents image) with a decolorable toner desired to be formed by a user such as an image from a document or an image transmitted from a personal computer. Still further, the image forming apparatus of the present embodiment forms a predetermined mark (called a given mark) by using toner (called an ordinary toner) not decolorized by being heated to the certain temperature. The mark is formed in a margin of a sheet so that the mark does not overlap the contents image.

If this sheet becomes a used sheet, the sheet is subjected to decolorizing treatment by a decolorizing device, and thereafter, housed as a reusable sheet in a cassette of the image forming apparatus of the present embodiment. The decolorizing treatment erases the contents image formed from such a decolorable toner (though the contents image may not be erased completely). Meanwhile, the given mark is formed with an ordinary toner, and accordingly, it remains unremoved after the decolorizing treatment.

When printing on the reusable sheet housed in the cassette, the image forming apparatus of the present embodiment determines if the given mark is present on a side to be printed. If there is the mark on the side, it is determined that this side has been used at least once. Therefore, the sides of the sheet are reversed and an image is formed on the opposite side (rear side).

As a result, even if there is a ghost image on a side produced due to incomplete decolorizing treatment, this side is not used but the opposite side is used for printing. Thus, degradation of legibility of an image printed for the second time and subsequent times can be alleviated.

The image forming apparatus of the present embodiment will now be described below by referring to the drawings.

FIG. 1 is a longitudinal sectional view schematically showing the structure of an image forming apparatus (MFP: multifunction peripheral) of the present embodiment. The image forming apparatus 100 includes a reading section R and an image forming section P.

The reading section R has the function of reading images of one-page documents and two-page documents by scanning. The reading section R includes a scanning optical system 10 with a plurality of reflecting mirrors and an image capturing element, and an automatic document feeder (ADF) 9 that automatically conveys a document to a given position for placement. An image of a document automatically conveyed onto a document tray Rt by the ADF 9 or an image of a document placed on a document table not shown in the drawings is read by the scanning optical system 10.

The image forming section P forms a developer image on a sheet on the basis of an image read from a document by the reading section R or image data transmitted from an external unit to the image forming apparatus 100, for example. The image forming section P includes photosensitive bodies 2Y, 2M, 2C, 2K, and 2B (2 in FIG. 2), developing rollers 3Y, 3M, 3C, 3K, and 3B, mixers 4Y, 4M, 4C, 4K, and 4B, an intermediate transfer belt 6, a fixing device 7, and a discharge tray 8. The photosensitive body 2B, the developing roller 3B, and the mixer 4B are units to form an image with a decolorable toner. The other photosensitive bodies 2Y, 2M, 2C, and 2K, the other developing rollers 3Y, 3M, 3C, and 3K, and the other mixers 4Y, 4M, 4C, and 4K are units to form an image with respective ordinary toners.

The image forming apparatus 100 further includes a control board 800 responsible for overall control of all hardware components of the image forming apparatus 100. The control board 800 has a processor 801 being an arithmetic processing unit (such as a CPU (central processing unit) and an MPU (micro processing unit)), an ASIC (application specific integrated circuit) 802, and a memory 803 with a volatile storage device and a nonvolatile storage device. The processor 801 loads a program stored in advance in a nonvolatile storage area of the memory 803 into a volatile area thereof and executes the loaded program, thereby realizing various functions. The embodiment may also be implemented such that some of or all these functions are realized by the ASIC 802. The memory 803 can be composed of a ROM (read-only memory), a SRAM (static random access memory), a DRAM (dynamic random access memory), a VRAM (video RAM), and a hard disk drive, for example. The memory 803 stores various information and programs used in the image forming apparatus 100.

The image forming apparatus 100 further includes a control panel 810. The control panel 810 accepts instructions from a user and presents a processing substance to the user. In the present embodiment, a user can select by means of the control panel 810 a decolorable toner or an ordinary toner for formation of an image. The user can also select a sheet feeding cassette by means of the control panel 810.

A copying process will be described in outline below as an example of a process conducted by the image forming apparatus 100 with the aforementioned structure.

First, a sheet picked up by a pickup roller 51 is conveyed to registration rollers 52. The registration rollers 52 adjust timing of supply of the sheet such that the sheet and an image (contents image) to be formed on the sheet are synchronized with each other.

Meanwhile, the scanning optical system 10 reads a plurality of one-page documents automatically conveyed by the ADF 9 continuously.

Next, the control board 800 performs a predetermined image process on image data read from the documents by the reading section R. Then, electrostatic latent images corresponding to the data after being subjected to the image process are formed on photosensitive surfaces of the photosensitive bodies 2Y, 2M, 2C, 2K, and 2B that function to transfer Y (yellow), M (magenta), C (cyan), K (black), and B (decolorable toner in blue, for example) developer images on sheets.

Next, developers stirred by the mixers 4Y, 4M, 4C, 4K, and 4B of a developing unit are supplied by the developing rollers (what are called magnetic rollers) 3Y, 3M, 3C, 3K, and 3B onto the photosensitive bodies 2Y, 2M, 2C, 2K, and 2B on which the electrostatic latent images have been formed as described above. As a result, the electrostatic latent images on the photosensitive surfaces of the photosensitive bodies 2Y, 2M, 2C, 2K, and 2B become visible images.

In the present embodiment, a given mark is formed with an ordinary toner (any one, any part, or all of Y, M, C and K toners) on the photosensitive surfaces of the photosensitive bodies 2Y, 2M, 2C, and 2K. This mark is formed in a margin of a sheet.

Developer images (contents images and given marks) formed on the photosensitive bodies 2Y, 2M, 2C, 2K, and 2B are transferred onto a belt surface of the intermediate transfer belt 6 (what is called primary transfer). The developer images conveyed in response to rotation of the intermediate transfer belt 6 are transferred at a certain secondary transfer position T onto the sheets being conveyed.

The developer images transferred to the sheets are fixed in the fixing device 7 by applying heat to the sheet. The sheets on which the developer images are fixed with heat are conveyed along a conveying path by a plurality of conveying roller pairs, and are discharged sequentially onto the discharge tray 8.

In addition to the aforementioned structures, the image forming apparatus 100 includes a reading sensor 60 that scans the sides of a sheet. The reading sensor 60 is a CCD (charge-coupled device) image sensor to determine if a given mark is present on a side (side targeted for printing) of a sheet being conveyed. The reading sensor 60 is arranged upstream of a sheet conveying direction with respect to the registration rollers 52. The image forming apparatus 100 includes an ADU (automatic duplexing unit) 70 that reverses sides of a sheet. A route (path) along which the reversed sheet is conveyed to the reading sensor 60 is formed inside the ADU 70.

Figure 2:
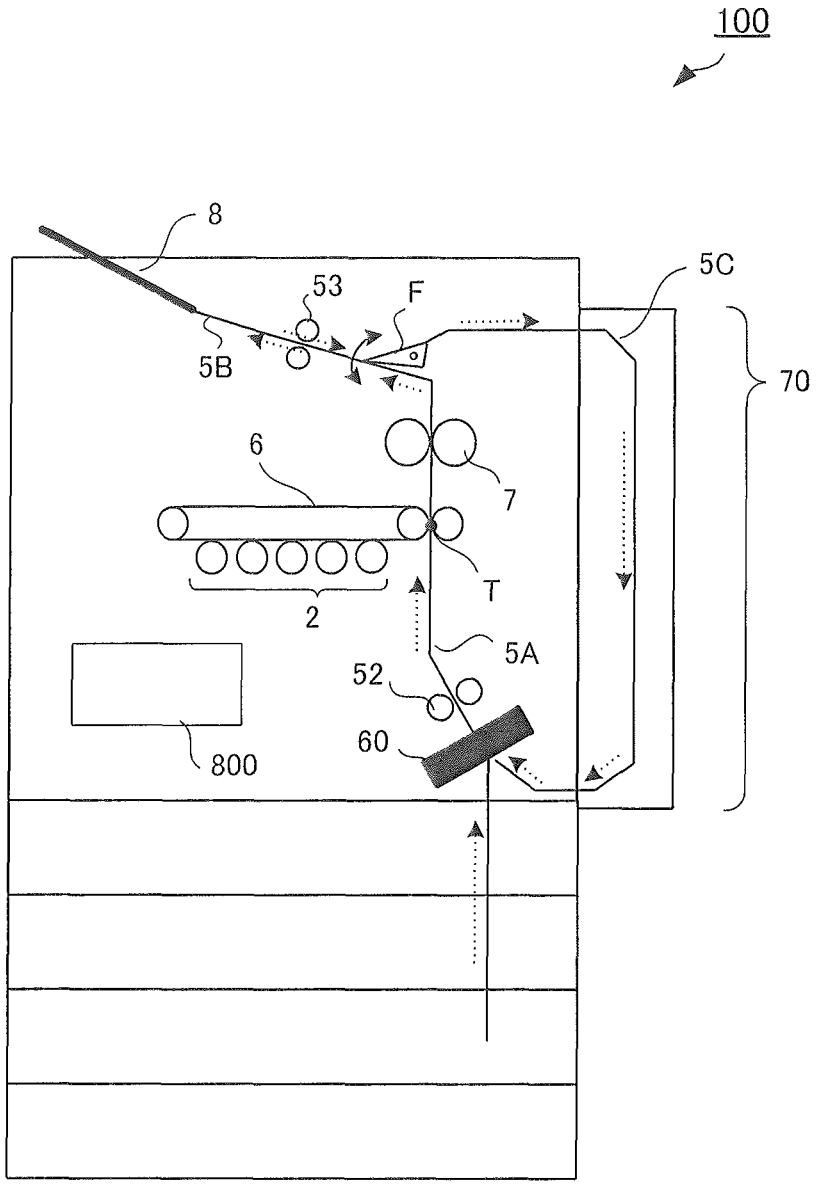
FIG. 2 shows the exemplary structure of the image forming apparatus of the embodiment and expressly shows an example of a conveying route for a sheet.

FIG. 2 is a schematic sectional view of the image forming apparatus 100 expressly showing an example of the conveying route for a sheet with dashed arrows. The description given below is based on the assumption that a sheet holding a contents image formed from a decolorable toner and a given mark formed from an ordinary toner is used as a reusable sheet after the sheet was subjected to decolorizing treatment. Therefore, a given mark is not erased but it remains on one or on both sides of a reusable sheet.

The conveying route of the image forming apparatus 100 includes a path 5A along which sheets are conveyed sequentially to the intermediate transfer belt 6 and the fixing device 7, a path 5B to reverse sheet sides, and a path 5C along which the reversed sheet is conveyed. The conveying path 5C becomes the conveying route after the ADU 70 is attached to a main body part of the image forming apparatus 100.

The reading sensor 60 scans a sheet side on which an image is to be formed (this side is regarded as a front side), and the control board 800 analyzes image data obtained after the scanning. This analysis includes a determining process to determine if a given mark is contained in the image data. A sheet is placed on standby at the registration rollers 52 until a result of the determination is provided.

If there is no given mark, a contents image is formed on the front side as is and a given mark is formed on the front side with an ordinary toner. The processed sheet is discharged through the path 5B to the discharge tray 8. At this time, a tip end of a blade of a flapper F is caused to turn upward under control of the control board 800 to ensure the route leading to the conveying path 5B. Upon receipt of driving force generated by forward rotation of a roller pair 53 (rotation to cause the sheet to travel toward the discharge tray 8), the sheet reaches the discharge tray 8 and is discharged thereon.

Meanwhile, if there is a given mark, an image is not formed on the sheet at this moment but the sheet is conveyed to the path 5B after passing through the path 5A. After the sheet is conveyed to the path 5B, the tip end of the blade of the flapper F comes into abutting contact with the path 5B to ensure a conveying route leading to the path 5C. Next, the roller pair 53 rotates in a reverse direction to convey the sheet to the path 5C, so that the sheet is conveyed to the reading sensor 60 again. As a result, a rear side in turn becomes a side on which an image is to be formed by the image forming section P. A contents image is formed on this rear side, and the sheet is discharged to the discharge tray 8 through the path 5B.

Figure 3:
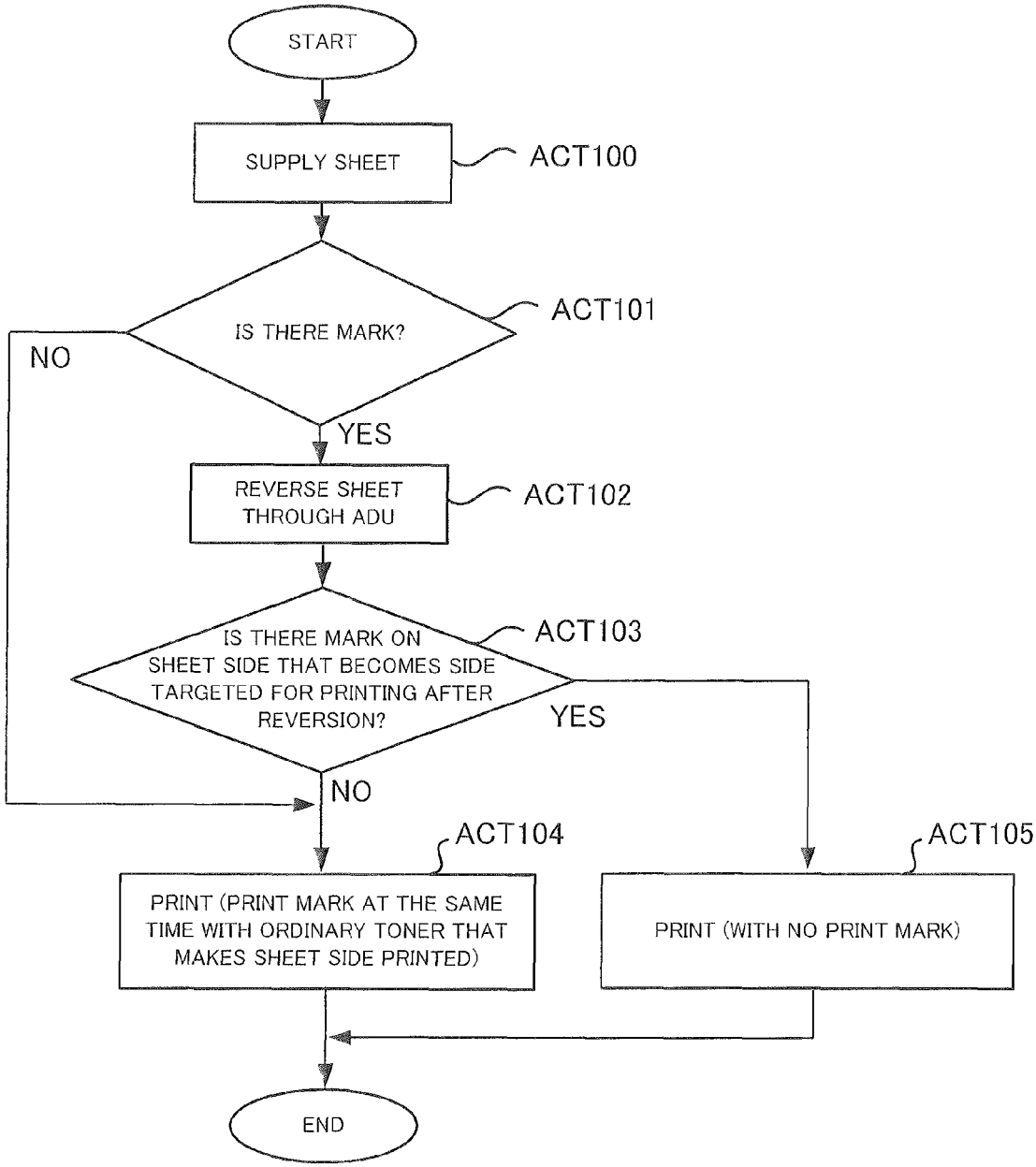
FIG. 3 is a flowchart explaining an example of operation of the image forming apparatus of the embodiment.

FIG. 3 is a flowchart explaining an example of operation of the image forming apparatus 100. The pickup roller 51 picks up a sheet stored in a cassette, and supplies the sheet to the image forming section P of the image forming apparatus 100 (ACT 100). The reading sensor 60 scans one side (a front side, or a side on which an image is to be formed) of the supplied sheet. The control board 800 acquires image data obtained by scanning to determine if the image data contains a given mark (ACT 101). If there is no given mark (ACT 101, NO), this side of the sheet is determined to be an unused side. Therefore, the image forming section P forms a contents image on this sheet side as is (ACT 104). A given mark is formed at the same time with an ordinary toner in ACT 104.

In contrast, if there is a given mark (ACT 101, YES), this sheet side has been used once or more than once. Therefore, the control board 800 controls the flapper F, the roller pair 53 and each path 5*b* and 5C to reverse sheet sides and to convey the sheet to the reading sensor 60 through the ADU 70 (ACT 102).

The reading sensor 60 again scans a side of the reversed sheet which becomes a side targeted for printing after the reversion. The control board 800 acquires image data obtained by scanning to determine if the image data contains a given mark (ACT 103). If there is still a given mark on the reverse side (ACT 103, YES), the control board 800 controls the image forming section P not to form a given mark on this side as this side already contains the mark. Under control of the control board 800, the image forming section P prints only a contents image while a given mark is not formed again (ACT 105). In contrast, if there is no given mark on the reverse side (ACT 103, NO), the image forming section P prints a contents image and prints a given mark on the same side with an ordinary toner (ACT 104). In the instant example, decolorable toners are used for printing of contents images in ACT 104 and ACT 105. Meanwhile, ordinary toners may be used instead.

The reading sensor 60 of the aforementioned example scans one of print sides of a sheet, and scans the other side after the sides are reversed. The reading sensor 60 may also be a sensor that reads both sides at a time. In this case, the reading sensor 60 scans both sides at a time. If there is a given mark on the rear side, the rear side is also determined to be a used side. Therefore, the control board 800 controls the roller pair 53, the flapper F, and the paths 5B and 5C so as not to reverse the sides. To be specific, a print is formed on the front side as is without reversing the sides.

A given mark is printed with an ordinary toner at a position and at a concentration that do not affect a contents image. A given mark is a predetermined mark, and can be any symbol, pattern, or character. A given mark may also be a character string or a pattern conforming to a prescribed format defining date and time of printing or identifying information unique to an image forming apparatus.

A given mark may be a mark visually recognizable by a user, or a mark formed by using a conventional technique such as a holography technique and a watermark printing technique and which can be recognized if seen at a certain angle. Or, a given mark may be a latent mark that is invisible (or hard to view) with the naked eye. According to the technique such as the watermark printing technique, a pattern image is embedded in an entire sheet to an extent by which a user cannot recognize the pattern image visually (or finds difficulty in the visual recognition). The embodiment may also be implemented such that this pattern image is employed as a given mark.

The aforementioned example is based on the assumption that a sheet to be reused holds a contents image formed from a decolorable toner and a given mark formed from an ordinary toner. However, this is not the only case of the example. The aforementioned example is also applicable to the case where a sheet to be reused is a sheet holding a contents image and a given mark both formed from an ordinary toner. The aforementioned example is further applicable to the case where a sheet to be reused is a sheet holding a contents image and a given mark both formed from a decolorable toner and which becomes a reusable sheet after being subjected to decolorizing treatment. In this case, determination is made based on the residual concentration of the given mark. For example, if a given mark remains on a side to a degree that makes the given mark detectable by the reading sensor 60 (if there is a given mark), the control board 800 determines this case as erasing failure. Then, the control board 800 exerts control to reverse sheet sides. If a given mark is not detected (if there is no given mark) on a side, the control board 800 determines that erasing process including erasure of a contents image has ended satisfactorily. Then, the control board 800 exerts control to form an image on this side.

The embodiment may also be implemented such that the condition of a sheet is detected and an image is formed on a side in a favorable condition. In the present embodiment, a decolorable toner in a single color (blue) is described as one that is used for image formation. Meanwhile, if an image is formed in full colors, the decolorizing device heats a sheet for a longer time. This degrades a sheet more seriously than the case where an image is formed in a single color. Therefore, the reading sensor 60 scans both the front and rear sides entirely, and the control board 800 determines if an image left undecolorized on each of the front and rear sides due to erasing failure of image data is a color image or an image in a single color. If the ghost image on the front side is a color image and the ghost image on the rear side is an image in a single color, for example, the control board 800 controls the roller pair 53, the flapper F, and the paths 5B and 5C such that an image is formed on a side in a favorable condition, specifically, on the rear side. The image forming section P forms an image on a side after the control, specifically, on a side in a favorable condition. The reading sensor 60 acting in this case is a color sensor that recognizes colors. The embodiment may also be implemented such that the reading sensor 60 scans both sides at a time. Alternatively, the embodiment may be implemented such that, if the reading sensor 60 is capable of scanning only one side, it scans one side first, and then scans the other side after sheet sides are reversed.

The embodiment may also be implemented such that, for determination of a sheet condition, the number of times a sheet side is used is counted and a sheet side used a smaller number of times is determined as one in a favorable condition. Then, like in the aforementioned control relating to determination as to if an image is a color image or an image in a single color, an image is formed on a side in a favorable condition. As an example of this implementation, a given mark is a tally mark and the like that makes a count of the number of times a sheet side is printed. The embodiment may also be implemented such that the control board 800 acquires an image of a tally mark or tally marks through the reading sensor 60 to determine the number of times this sheet side is used. In this case, one line is added to a current tally mark or tally marks in ACT 104 and ACT 105, for example. The embodiment may also be implemented such that the reading sensor 60 acting in this case scans both sides at a time. Alternatively, the embodiment may be implemented such that, if the reading sensor 60 is capable of scanning only one side, it scans one side first, and then scans the other side after sheet sides are reversed.

The implementation of checking a sheet condition and forming an image on aside in a favorable condition may be added to the aforementioned implementation of determining the presence or absence of a given mark, or may be prepared as a function different from determination of the presence or absence of a given mark. An image forming apparatus implementing only this function may be provided.

Meanwhile, the aforementioned determination as to the presence or absence of a given mark is also considered as one of methods of checking a sheet condition and forming an image on a side in a favorable condition. To be specific, a side with no given mark has never been used, and accordingly, it is regarded as a side in a favorable condition. Further, a side with a given mark has a side that has been used at least once, and accordingly, it is regarded as a degenerate side in an unfavorable condition. Therefore, the control board 800 can determine if a sheet side is in a favorable or unfavorable condition by determining the presence or absence of a given mark. The control board 800 determines that a side with no given mark is regarded as a side in a favorable condition, and exerts control for reversion to form an image on this side.

As described in detail above, the technique described herein is capable of reducing the probability of formation of an image on a sheet side that has been used once.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a sensor configured to read a side of a sheet on which an image is to be formed before formation of the image;

a reversing section configured to reverse sides of the sheet being conveyed;

an image forming section configured to form the image and a predetermined mark on the same side of the sheet; and a controller configured to acquire image data read by the sensor, and if the image data contains the mark, to cause the reversing section to reverse the sides of the sheet and to cause the image forming section to form the image on a side that becomes a side targeted for printing after the reversion.

2. The image forming apparatus according to claim 1, wherein the image forming section forms the image with a color material decolorized by being heated to a certain temperature, and forms the mark with a color material not decolorized by being heated to the certain temperature.

3. The image forming apparatus according to claim 2, wherein the sheet is a sheet on which a print has been formed in the past by the image forming section, and after being heated to the certain temperature or higher temperature.

4. The image forming apparatus according to claim 1, wherein the sensor further reads the sheet side that becomes a side targeted for printing after the reversion by the reversing section, and the controller further acquires image data read by the sensor after the reversion, and if this image data contains the mark, the controller controls the image forming section to avoid formation of the mark.

5. The image forming apparatus according to claim 1, wherein the sensor further reads a side opposite to the sheet side on which the image is to be formed before formation of the image by the image forming section, and the controller acquires image data about the opposite side read by the sensor, and if this image data contains the mark, the controller causes the reversing section not to reverse the sides of the sheet.

6. The image forming apparatus according to claim 1, wherein the sensor further reads a side opposite to the sheet side on which the image is to be formed, and the controller further acquires image data about the opposite side read by the sensor, selects a side in a favorable condition on the basis of the acquired image data about both the sides, and controls the reversing section such that the image is formed on the selected side in a favorable condition.

7. The image forming apparatus according to claim 6, wherein the sensor is a color sensor that recognizes colors, and the controller determines if images detected from the image data are in a plurality of colors or in a single color, and controls the reversing section such that the image is formed on a side on which an image is formed in a single color.

8. The image forming apparatus according to claim 6, wherein the mark is a tally mark indicating the number of times of printing, and the controller determines the number of times of printing about each side on the basis of a tally mark contained in the image data, and controls the reversing section such that the image is formed on a side with a smaller number of times of printing.

9. The image forming apparatus according to claim 1, wherein the image forming section forms the mark in a margin so that the mark does not overlap the image.

10. The image forming apparatus according to claim 1, wherein the image forming section forms the mark as a latent image.

11. An image forming apparatus, comprising:

a sensor configured to read both sides of a sheet before formation of an image;

a reversing section configured to reverse sides of the sheet being conveyed;

an image forming section configured to form the image on the sheet; and a controller configured to acquire image data about both the sides read by the sensor, the controller selecting a side in a favorable condition on the basis of the acquired image data, and controlling the reversing section such that the image is formed on the selected side in a favorable condition by the image forming section.

12. The image forming apparatus according to claim 11, wherein the image forming section forms the image with a color material decolorized by being heated to a certain temperature, and the sheet is a sheet on which a print has been formed in the past by the image forming section, and after being heated to the certain temperature or higher temperature.

13. An image forming method applied to an image forming apparatus, the method comprising:

reading aside of a sheet on which an image is to be formed before formation of the image;

reversing sides of the sheet if there is a predetermined mark in image data obtained by the reading; and forming the image and the mark on the same side that becomes a side targeted for printing after the reversion.

14. The image forming method according to claim 13, wherein regarding the forming, the image is formed from a color material decolorized by being heated to a certain temperature, and the mark is formed from a color material not decolorized by being heated to the certain temperature.

15. The image forming method according to claim 14, wherein the sheet is a sheet on which a print has been formed in the past by the image forming apparatus, and after being heated to the certain temperature or higher temperature.

16. The image forming method according to claim 13, wherein before the forming, further reading the sheet side that becomes a side targeted for printing after the reversion, and avoiding formation of the mark if image data read after the reversion contains the mark.

17. The image forming method according to claim 13, comprising further reading a side opposite to the sheet side on which the image is to be formed before the forming, and avoiding the reversion if image data about the opposite side acquired by reading contains the mark.

18. The image forming method according to claim 13, comprising further reading a side opposite to the sheet side on which the image is to be formed before the forming, and selecting a side in a favorable condition on the basis of image data about both the sides acquired by reading, and controlling the reversion such that the image is formed on the selected side in a favorable condition.

19. The image forming method according to claim 13, wherein the mark is formed in a margin so that the mark does not overlap the image.

20. The image forming method according to claim 13, wherein the mark is a latent image.

* * * * *